US007876032B2

(12) United States Patent
Arndt et al.

(10) Patent No.: US 7,876,032 B2
(45) Date of Patent: Jan. 25, 2011

(54) LIGHT UNIT PROVIDED WITH REFLECTOR

(75) Inventors: Joachim Arndt, Brieselang (DE); Uwe Fidler, Berlin (DE); Markus Herb, Günzburg (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 392 days.

(21) Appl. No.: 11/883,747

(22) PCT Filed: Feb. 2, 2006

(86) PCT No.: PCT/DE2006/000161

§ 371 (c)(1),
(2), (4) Date: Aug. 6, 2007

(87) PCT Pub. No.: WO2006/081804

PCT Pub. Date: Aug. 10, 2006

(65) Prior Publication Data

US 2008/0158890 A1 Jul. 3, 2008

(30) Foreign Application Priority Data

Feb. 4, 2005 (DE) ..... 10 2005 005 262

(51) Int. Cl.
*F21V 7/08* (2006.01)

(52) U.S. Cl. ..... 313/113; 362/310; 362/343; 313/318.01; 313/318.07; 313/318.09

(58) Field of Classification Search ..... 362/343, 362/310; 313/113, 318.07, 318.01, 318.09
See application file for complete search history.

(56) References Cited

U.S. PATENT DOCUMENTS

| | | | | |
|---|---|---|---|---|
| 2,438,231 | A * | 3/1948 | Schultz et al. | 401/244 |
| 4,564,783 | A * | 1/1986 | Krieg et al. | 313/113 |
| 4,935,660 | A * | 6/1990 | Heider et al. | 313/25 |
| 6,469,428 | B1 * | 10/2002 | Thiel et al. | 313/318.09 |
| 2004/0178207 | A1 * | 9/2004 | Kim | 220/714 |
| 2007/0090739 | A1 * | 4/2007 | Lin | 313/113 |

FOREIGN PATENT DOCUMENTS

| | | |
|---|---|---|
| DE | 20 49 362 | 4/1972 |
| DE | 21 39 243 | 2/1973 |
| EP | 0 334 208 | 9/1989 |
| EP | 0 336 478 | 10/1989 |
| WO | WO 03/083900 | 10/2003 |
| WO | WO 2004/046609 | 6/2004 |

* cited by examiner

*Primary Examiner*—Nimeshkumar D Patel
*Assistant Examiner*—Jacob Stern

(57) ABSTRACT

The invention relates to a light unit, comprising a concave reflector (7) with an outlet opening and an axis, whereby the reflector encloses a light source running in the direction of the axis. The light source is enclosed at a separation from an open-ended cylindrical protective tube (16), with a glare shield (19), provided at the open end of the protective tube. The glare shield (19) is a sheet, cupped over the burst-protection tube, whereby the glare shield comprises a semi-circular end piece with a given maximum diameter, on which a straight cylindrical section of greater diameter is mounted which itself is further provided with an offset screen (21).

7 Claims, 11 Drawing Sheets

LIGHT UNIT PROVIDED WITH REFLECTOR

TECHNICAL FIELD

The invention is based on a light unit provided with a reflector in accordance with the precharacterizing clause of claim 1. This is in particular a reflector lamp or a luminaire equipped with a reflector. The light source therein is in particular a high-pressure discharge lamp, but an incandescent lamp is also suitable for this purpose. The invention furthermore relates to a structural unit for use in such a light unit provided with a reflector.

PRIOR ART

WO 2004/046609 has disclosed a light unit having a concave reflector and a light source, which is in the form of a high-pressure discharge lamp. In this case an anti-glare device for the light source is fitted on an anti-burst protective tube, which surrounds the light source. For this purpose, the anti-burst protective tube has a circumferential dent, in which the dome-shaped anti-glare device is anchored.

Disadvantages of this holder are the fact that the anti-burst protective tube needs to be pretreated in a complex manner in order to make it possible for it to be anchored and that the anti-glare device needs to be equipped with an extra mechanism for anchoring purposes.

DESCRIPTION OF THE INVENTION

The object of the present invention is to provide a light unit in accordance with the precharacterizing clause of claim 1, which can be fitted easily and is very suitable for automation.

This object is achieved by the characterizing features of claim 1. Particularly advantageous embodiments can be gleaned from the dependent claims.

In detail, the invention relates to a light unit having a concave reflector with an outlet opening and an axis, the reflector surrounding a light source which is elongated in the axial direction, the light source being surrounded, at a distance, by a cylindrical protective tube with open ends, an anti-glare device being fitted to the opening-side end of the protective tube. In this case, the anti-glare device is a metal sheet, which is turned over the anti-burst protective tube, the anti-glare device comprising a hemispherical termination part with a given maximum diameter, on which a straight cylindrical section having a larger diameter is integrally formed, in turn a protruding shield being placed on said straight cylindrical section.

The diameter of the cylindrical section is preferably 5 to 20% larger than the maximum diameter of the termination part. In this case, the connection between the two parts is produced in particular by a step-shaped shoulder.

The reflector-side edge of the anti-burst protective tube is advantageously enlarged in the form of a droplet, which is possible in particular in a simple manner by means of flame-rounding, the reflector-side end of the anti-burst protective tube being matched to the diameter of the cylindrical section from the inside, with the result that the anti-glare device rests in clamping fashion on the anti-burst protective tube, with the step as a stop.

In particular, the light unit has a base, which holds the light source. In addition, the base can hold the anti-burst protective tube and possibly the reflector.

A particularly simple holder is provided if the anti-burst protective tube is also enlarged in the form of a droplet at its base-side edge and can therefore be held in clamping fashion by the reflector neck, in particular by a suitably shaped bead or channel. The deformation of the reflector neck generally needs to be just above the droplet. Instead of a droplet, a drilled hole can also act as the holding means, into which drilled hole the reflector neck is fixed, for example by means of crimping.

The light unit is in particular a reflector lamp or else a reflector luminaire.

The light source is essentially a metal halide lamp. A typical power range is from 20 to 150 W. An anti-glare cap is additionally assigned to the light source in addition to a protective tube, which imparts, in particular, protection against bursting. However, an application is also possible in incandescent lamps.

The anti-glare cap is turned over the light source in order to avoid glare in the reflector.

The protective tube is made from a vitreous material and in particular consists of hard glass or quartz glass. It is a cylindrical tube which is open at two ends. The invention achieves simple mechanical fixing of the anti-glare device to the anti-burst protective tube. The anti-glare device is preferably, but not necessarily, a metal sheet. It can also be manufactured from plastic which is resistant to high temperatures or else polymer ceramic. The term polymer ceramic means a ceramic consisting of a material which is also referred to as a polymer/ceramic composite material or polymer/matrix composite material or polymer/ceramic composite. In this case the composite material may be inorganic, organic or a mixture of organic and inorganic components.

Such materials are known per se, for example, from the literature such as the textbook Werkstoffe Materials, Springerverlag, ISBN 3540573259. Known materials are, for example, carbide and nitride materials of inorganic polymers. The thermal stability of silicon carbonitride ceramics is very high.

In particular, the wall thickness of the anti-glare material is approximately 0.2 to 1.5 mm; in the case of sheet metal it tends to be thinner and in the case of other materials it tends to be thicker. The anti-glare cap in this case has such a geometry and is fixed to the anti-burst protective tube in such a way that it is not possible for the viewer to see directly the luminous center of the light source.

In detail, the anti-glare device can be produced from one part. It is preferably a deep-drawn metal sheet, but a deep-pressed metal sheet is also possible. In the case of nonmetallic materials, it may be sprayed (plastic or polymer ceramic). However, the anti-glare device may also have a multi-part design. The parts may be welded together, but may also be crimped, bent, clipped or injection-molded.

The geometry of the anti-glare device is selected such that, once the anti-glare device has been placed onto the anti-burst protective tube, the luminous part, for example the discharge vessel, is no longer visible. The term anti-burst protective tube does not only mean, but preferably means, protection against explosion of the discharge vessel or the innermost bulb. No hot contents should emerge from the protective tube. With an unsupported construction without any additional holding elements such as clips etc. a roll or flange neck is integrally formed on the upper opening edge of the protective tube by means of flame-rounding or else in another way. In this case, the increase in the diameter should be of the order of magnitude of from 5 to 10% and should not exceed 20%.

With such an unsupported construction, the protective bulb can also be fixed in an interlocking manner in the base region, for example by means of cementing. In order to fix the anti-glare cap particularly securely, latching connections, in particular sprung elements, are provided in the cap which bring about latching-in by means of being pressed over the roll or flange of the protective tube on joining and therefore prevent the cap from falling off even in the case of relatively severe vibrations.

Specifically, longitudinal beads are suitable for this purpose which are distributed uniformly around the circumference of the cylindrical section and are matched to the droplet-shaped enlarged portion precisely such that the droplet can latch precisely into the chamber between the step and the upper end of the bead.

The latching connection may also have sprung elements or a different geometry. One example are unlatched lugs with different shapes for snapping-in the flame-rounded enlarged glass portion or separately fitted spring tongues.

The flame-rounding is produced with the flame of a gas burner. It can produce, freely rounded, a droplet which is formed owing to the surface tension. However, after heating by means of the flame, it may also be placed on a form tool as long as the heated edge is still sufficiently warm. It is recommended in this case to allow the tube to be deformed to rotate in each case. The technique of flame-rounding has long been known per se, but has a high potential in terms of economy in connection with the combination of the protective tube and the anti-glare cap.

A second embodiment is a supported construction. In this case, the anti-glare cap is essentially likewise shaped, but without a step and with a constant diameter. Any clamping chambers are also dispensed with. In this case a clamping bracket, in the form of a wire or metal sheet, preferably consisting of spring steel with a round or rectangular cross section, is used for fixing purposes. A wire preferably has a diameter of from 1 to 3 mm. The clamping bracket is positioned over the anti-glare cap, which has been plugged onto the protective tube. The free ends of the clamping bracket are locked in associated cutouts, for example slits or holes, in the reflector. The clamping bracket is advantageously guided on the cover of the anti-glare cap, which is advantageously flat, in a depression, cutout or bead, and thus the fixing is improved.

The depression may in particular contain an eyelet part as a channel spanned by a roof, as a result of which the clamping bracket, once it has been threaded into the eyelet, can no longer be separated from the anti-glare cap. The connection between the clamping bracket and the reflector can be produced either by means of an interlocking connection (the ends being bent back, in particular in the case of a wire) or by a force-fitting connection (in particular holding by means of pure spring force of the bracket or by means of friction). The protective bulb is likewise fixed in a force-fitting manner and indirectly in this way.

An application area is in particular in reflector lamps based on metal-halide lamps which are particularly compact.

FIGURES

The invention will be explained in more detail below with reference to a plurality of exemplary embodiments. In the drawings:

FIG. 1 shows the side view of a reflector lamp in section (FIG. 1*a*) and as an enlarged detail (FIG. 1*b*);

FIG. 2 shows an exemplary embodiment of a dome, in a side view;

FIG. 3 shows a further exemplary embodiment of a reflector lamp in section (FIG. 3*a*) and in a view rotated through 90° (FIG. 3*b*) as well as a detail of the anti-glare device (FIG. 3*c*);

FIG. 4 shows a sectional drawing of a further exemplary embodiment of an anti-glare device;

FIG. 5 shows a further exemplary embodiment of a reflector lamp with the anti-glare device shown in FIG. 4;

FIG. 6 shows a further exemplary embodiment of a reflector lamp in a perspective view;

FIG. 7 shows the reflector lamp from FIG. 6 in section;

FIG. 8 shows a detail of FIG. 7;

FIG. 9 shows a detail of a holder for a dome, in a perspective view;

FIG. 10 shows a further exemplary embodiment of a reflector lamp with the dome holder shown in FIG. 9;

FIG. 11 shows a further exemplary embodiment of a reflector lamp in a perspective view;

FIG. 12 shows a further exemplary embodiment of a reflector lamp, in section; and FIG. 13 shows a detail of the tube for the reflector lamp shown in FIG. 12.

Figure 1A:
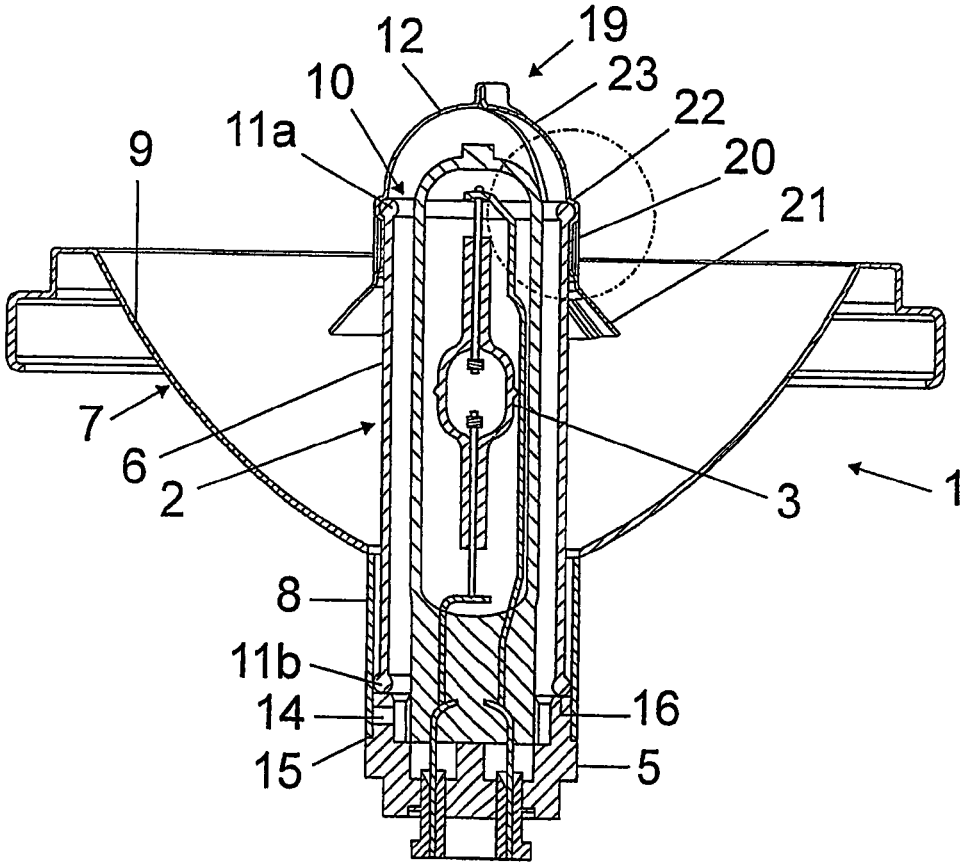
FIG. 1*a* shows a reflector lamp 1 having an inner vessel 2, comprising a discharge vessel 3, which is surrounded by an outer bulb 4. The inner vessel 2 rests in a central opening of a base, whose essential part is a base insulator 5. The inner vessel 2 is surrounded, at a distance, by an anti-burst protective tube 6, which is cylindrical and is aligned axially parallel. The anti-burst protective tube 6 itself is in turn surrounded by a reflector 7 consisting of aluminum. The reflector has a neck 8 and a contour 9. The diameter of the neck 8 is advantageously loosely matched to the diameter of the anti-burst protective tube 6 from the outside. Both parts are placed on the base 5.

The edges of the anti-burst protective tube are flame-rounded at their ends 10 on both sides, with the result that they each have a droplet-shaped enlarged portion 11*a*, 11*b* in cross section. However, the edge may also have another shape if it has also additionally been shaped after the flame treatment, for example an outwardly pointing boot-shaped enlarged portion. The neck 8 of the aluminum reflector is crimped on the base insulator 5. For this purpose lateral drilled holes 14 are provided on the base insulator. In this case, the neck is guided in a step-shaped cutout 15 of the base.

The anti-burst protective tube 6 is fixedly clamped with its base-side enlarged portion 11*b* in the neck 8. The anti-burst protective tube 6 rests on the upper side 16 of the base insulator.

Furthermore, an anti-glare device 19 is fitted to the central point of the reflector opening.

The anti-glare device is a shaped part, preferably a sheet-metal part, but also HT plastic or polymer ceramic, having a cover cap 12, which comprises a hemispherical termination part 23 and a section 20, which is cylindrical and is positioned with a step. The diameter of the cylindrical section 20 is approximately 10% larger than the maximum diameter of the hemispherical termination part. A rim or protruding shield 21, which protrudes at an angle, is integrally formed on the base-side end of the cylindrical section.

The step 22 between the termination part 23 and the cylindrical section 20 is used as a stop for the reflector-side end of the anti-burst protective tube. The edge of the anti-burst protective tube 6 is also flame-rounded here, with the result that the cylindrical section bears against the enlarged portion 11*a* of the edge in clamping fashion.

Figure 1B:
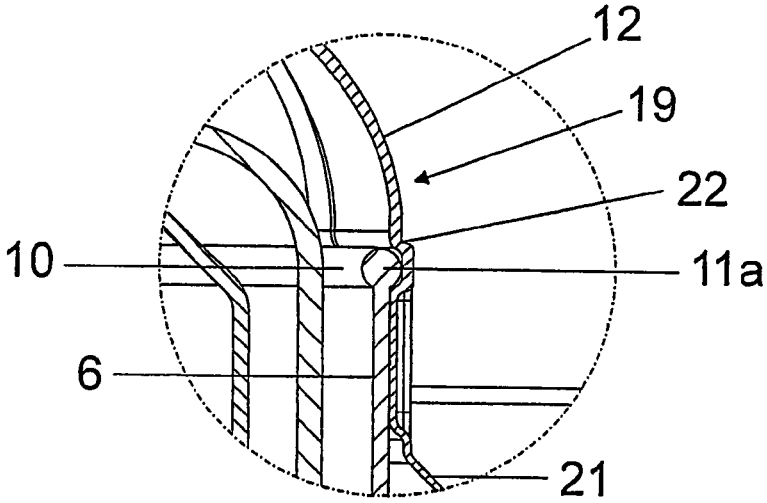

FIG. 1*b* shows a detail of the form-fitting and force-fitting connection between the opening-side, droplet-shaped enlarged portion 11*a* of the anti-burst protective tube 6 and the cap 12, which rests on that end 10 of the anti-burst protective tube 6 which points towards the opening of the reflector.

Figure 2:
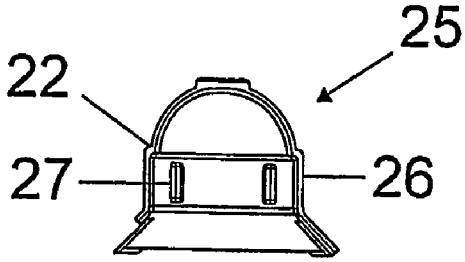

In a further exemplary embodiment of a cap 25 (FIG. 2), the cylindrical section 26 is equipped uniformly over its circumference with beads 27 which are arranged axially parallel. Its reflector-side end is selected such that the droplet-shaped enlarged portion 11*a* latches precisely into the chamber between the step 22 and the end of the bead in a sprung manner.

Figure 3A:
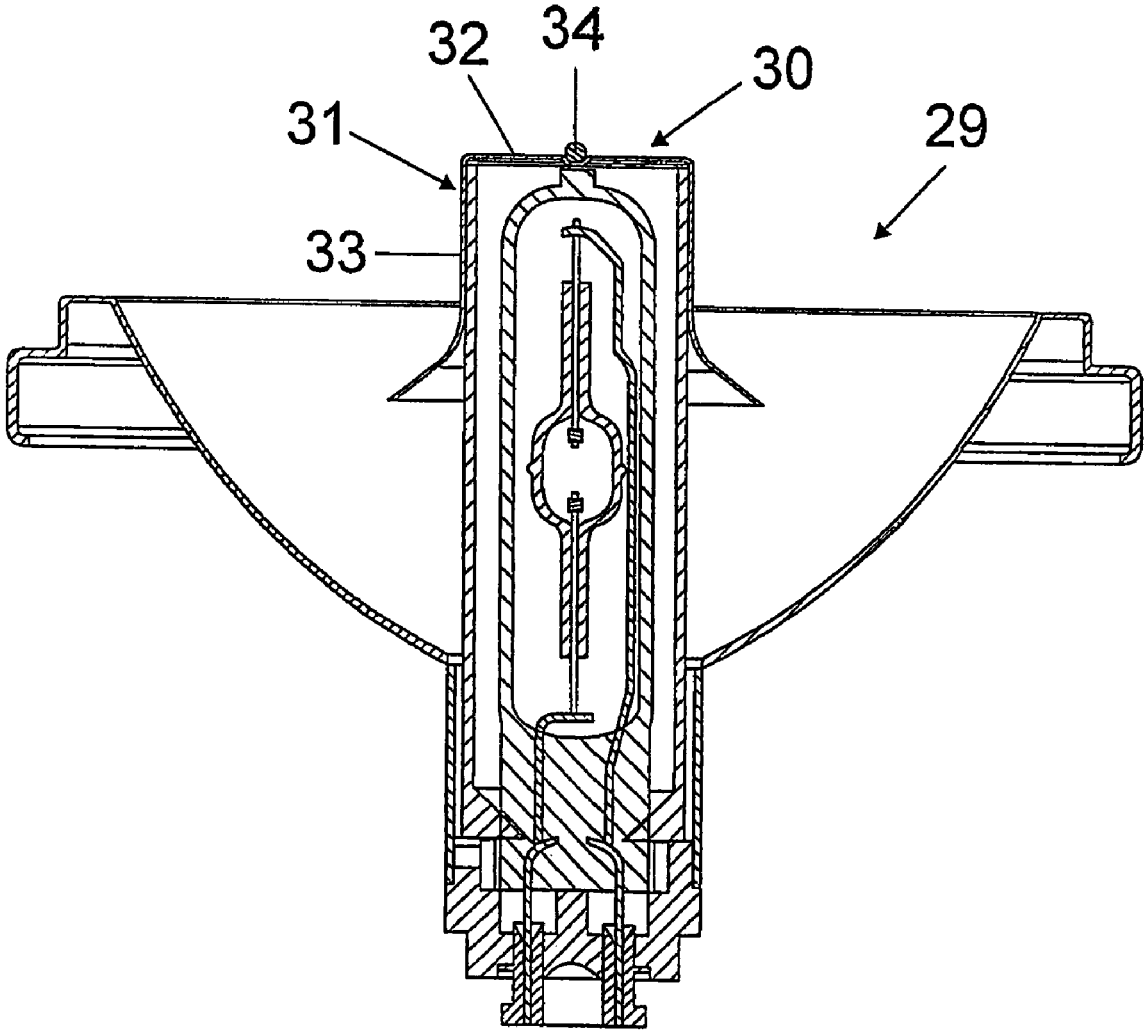
Figure 3B:
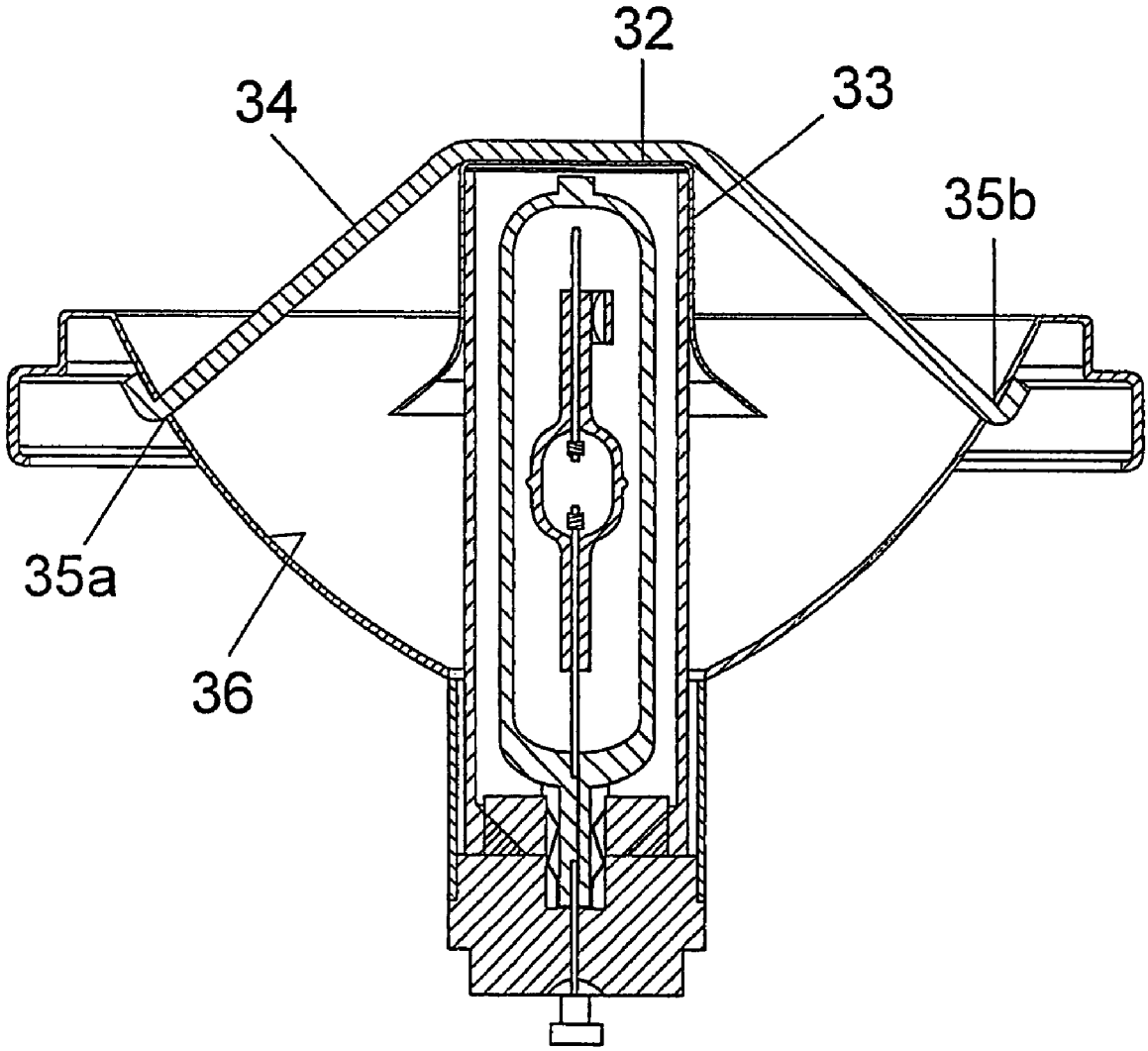
Figure 3C:
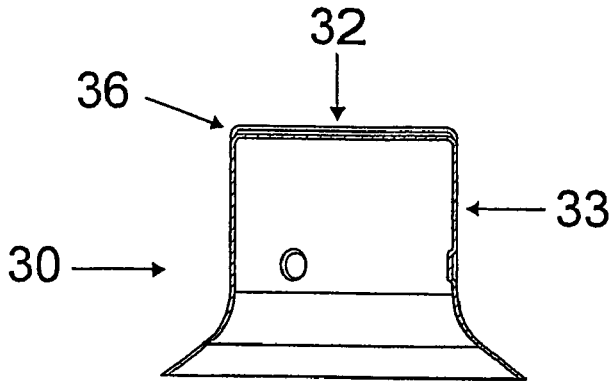

In a further exemplary embodiment (FIGS. 3*a* and 3*b*) of a reflector lamp 29, the anti-glare device 30 is designed such that the cap 31 is in the form of a pot, having a flat cover 32 and a straight side wall 33. Fixing takes place by means of a clamping bracket 34, which is stretched across the cover 32 or other parts of the cap and stretches from an opening 35 in the contour 36 of the reflector to a further opening 35*b* on the opposite side of the contour. Usually the bracket 34 is a wire with a diameter of typically from 0.5 to 2 mm. The cover 32 preferably has a guide for the bracket, for example a continuous dent 36, see the sectional drawing of the anti-glare device shown in FIG. 3*c*.

Figure 4:
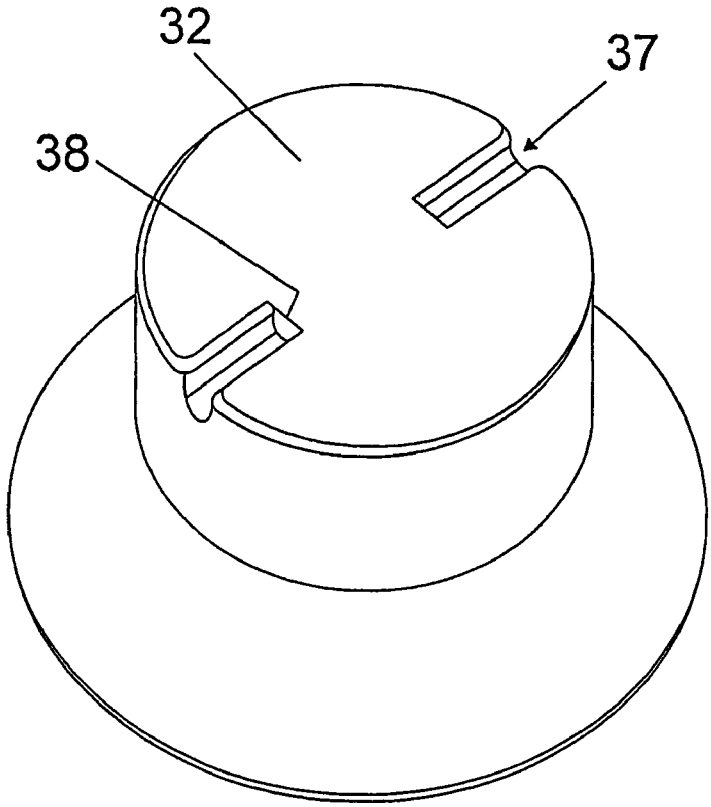
Figure 5:
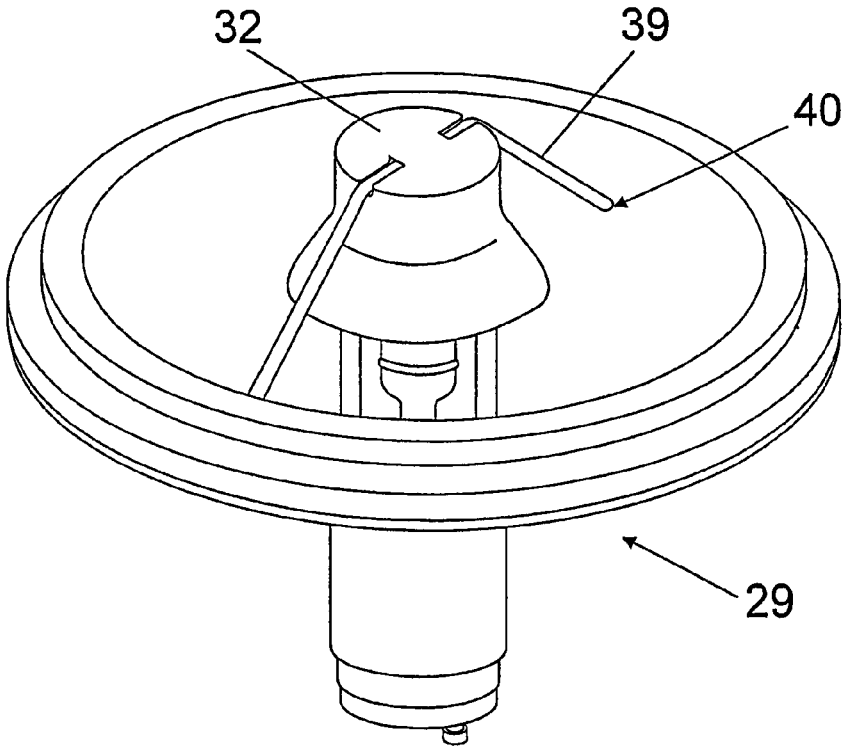

In a further exemplary embodiment of the anti-glare device, the dent 37 of the cap is interrupted by an eyelet 38, FIG. 4. The originally straight bracket 39 (the bracket only subsequently being bent in the form of a roof so that it has a straight central section) is first threaded into this eyelet and, after the bending process shown in FIG. 5, is anchored in a slot 40 of the reflector. FIG. 5 shows the associated reflector lamp.

Figure 6:
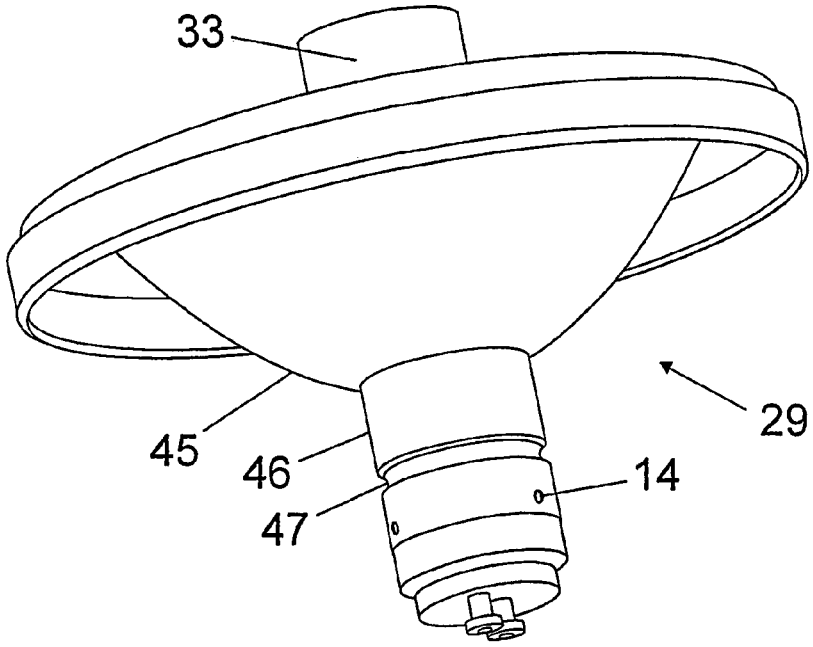

In the case of a reflector lamp 29, FIG. 6 shows fixing of the anti-burst protective tube by means of the aluminum reflector 45 from the outside. The neck 46 of the reflector has circumferential embossing 47, which fixes the anti-burst protective tube (not shown) just above the droplet-shaped enlarged portion thereof.

Figure 7:
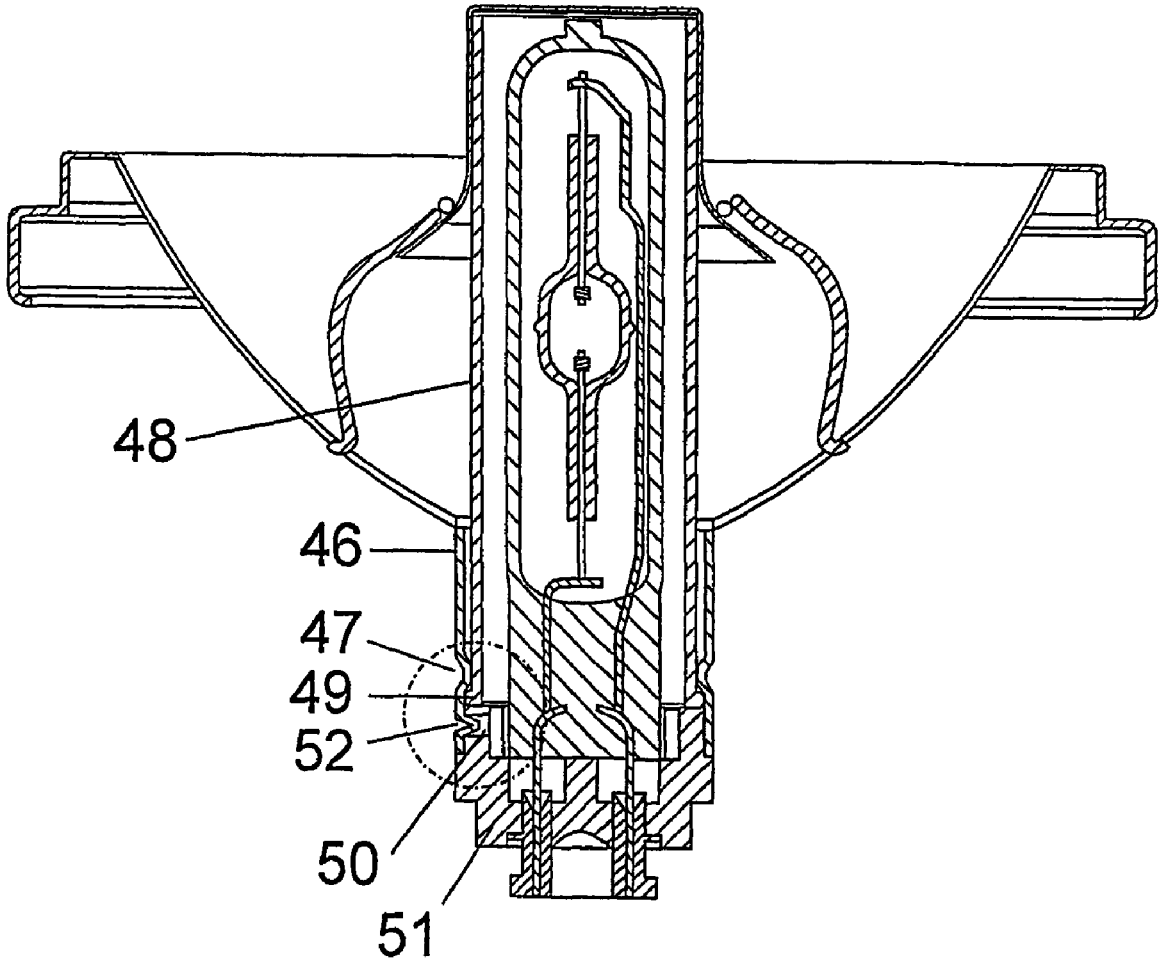
Figure 8:
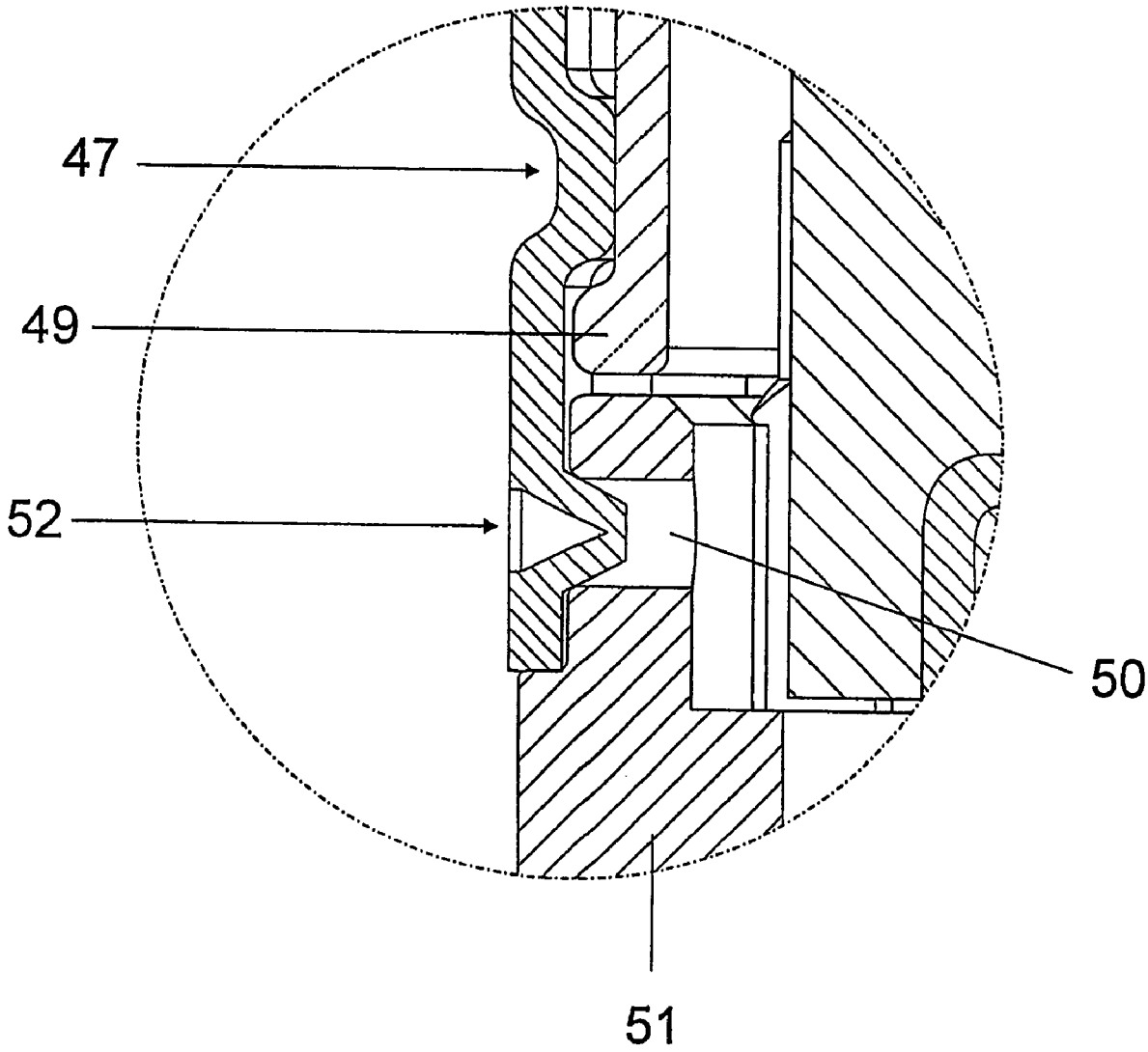

FIG. 7 shows the reflector lamp in section, showing clearly that, on one side, the neck 46 holds the anti-burst protective tube 48 by means of the embossing 47 over a boot-shaped enlarged portion 49 and, on the other side, the neck 46 is anchored in a drilled hole 50 of the base insulator 51 by means of crimping or a stamped-out lug 52, see the detail in FIG. 8.

Figure 9:
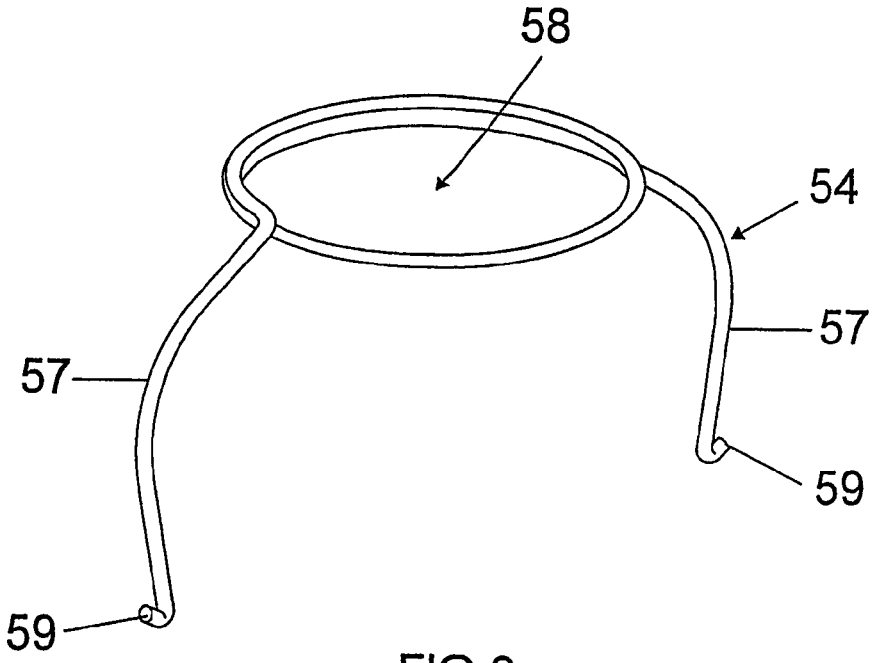
Figure 10:
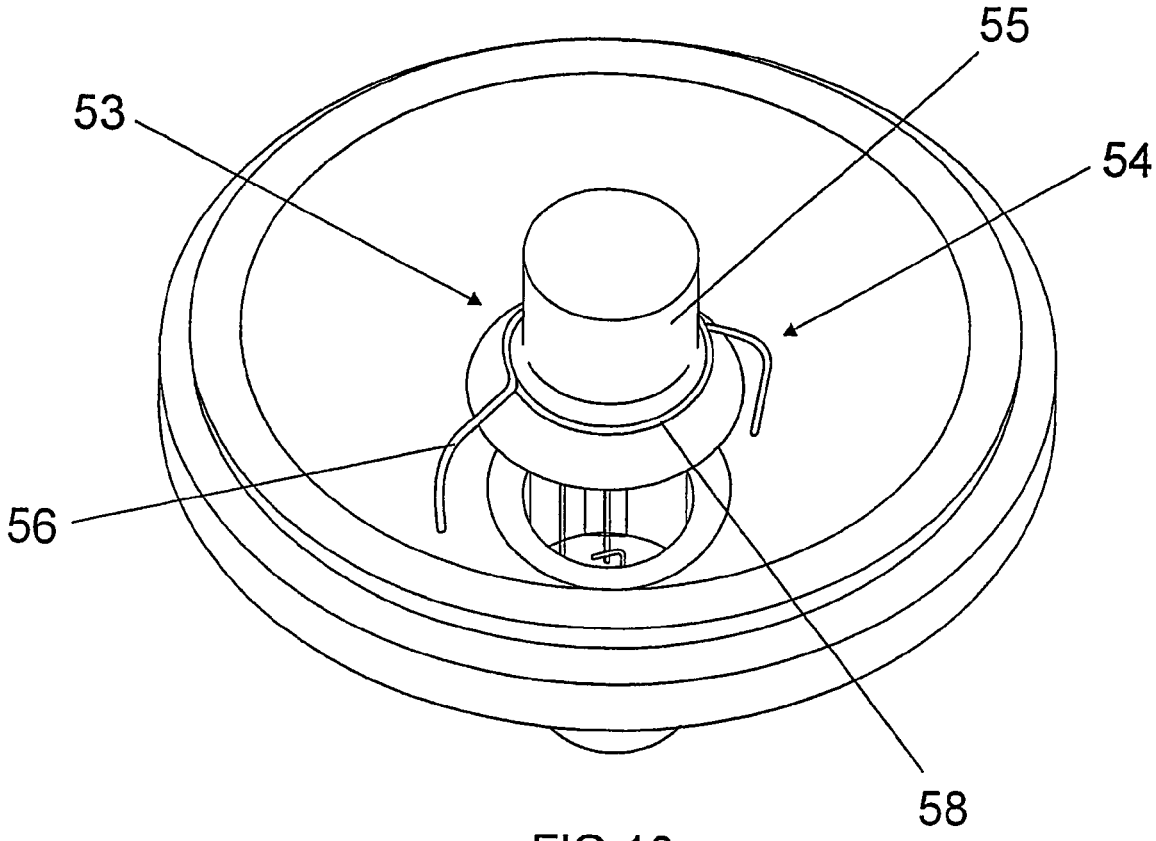

In a further exemplary embodiment (FIGS. 9, 10), the cap 53 is fixed by virtue of the fact that a wire bracket 54, which is shaped as a lasso, bears against the bend between the side wall 55 of the pot-like cover and the protruding rim 56. The bracket 54 has a complete loop 58, with two laterally protruding free ends 57 for latching in the reflector wall. FIG. 10 shows the entire reflector lamp, in which case no droplet-shaped enlarged portion on the anti-burst protective tube is required since this is an unsupported construction. In the case of an unsupported construction, a bracket is required instead of the enlarged portion, the bracket being fixed at its ends in the reflector wall by means of hooks 59.

Figure 11:
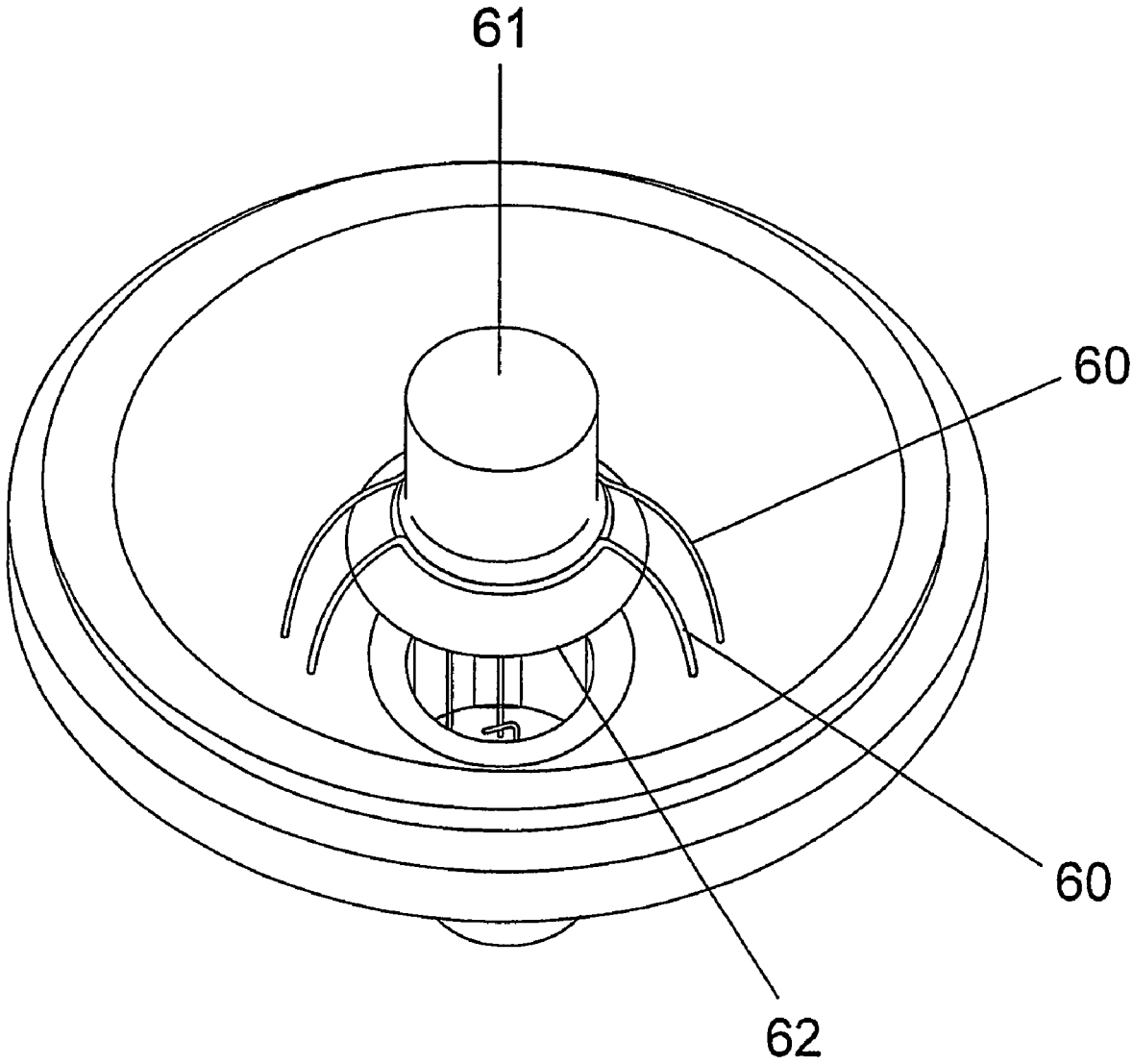

It is also possible to use two clamping brackets 60. The cap 61 in this case has a protruding rim 62, the clamping brackets 60 resting on the rim on two opposite sides and holding the cap in clamping fashion, see the exemplary embodiment of the reflector lamp in FIG. 11.

The protective tube is in this case often referred to as an anti-burst protective tube without this excluding another function of the protective tube. It is also possible for the protective tube to only have droplet-shaped enlarged portions at one end, with the result that, for example, an unsupported holding arrangement for the cap is combined with a holding arrangement which is based on an enlarged portion at the base-side end of the protective tube.

Figure 12:
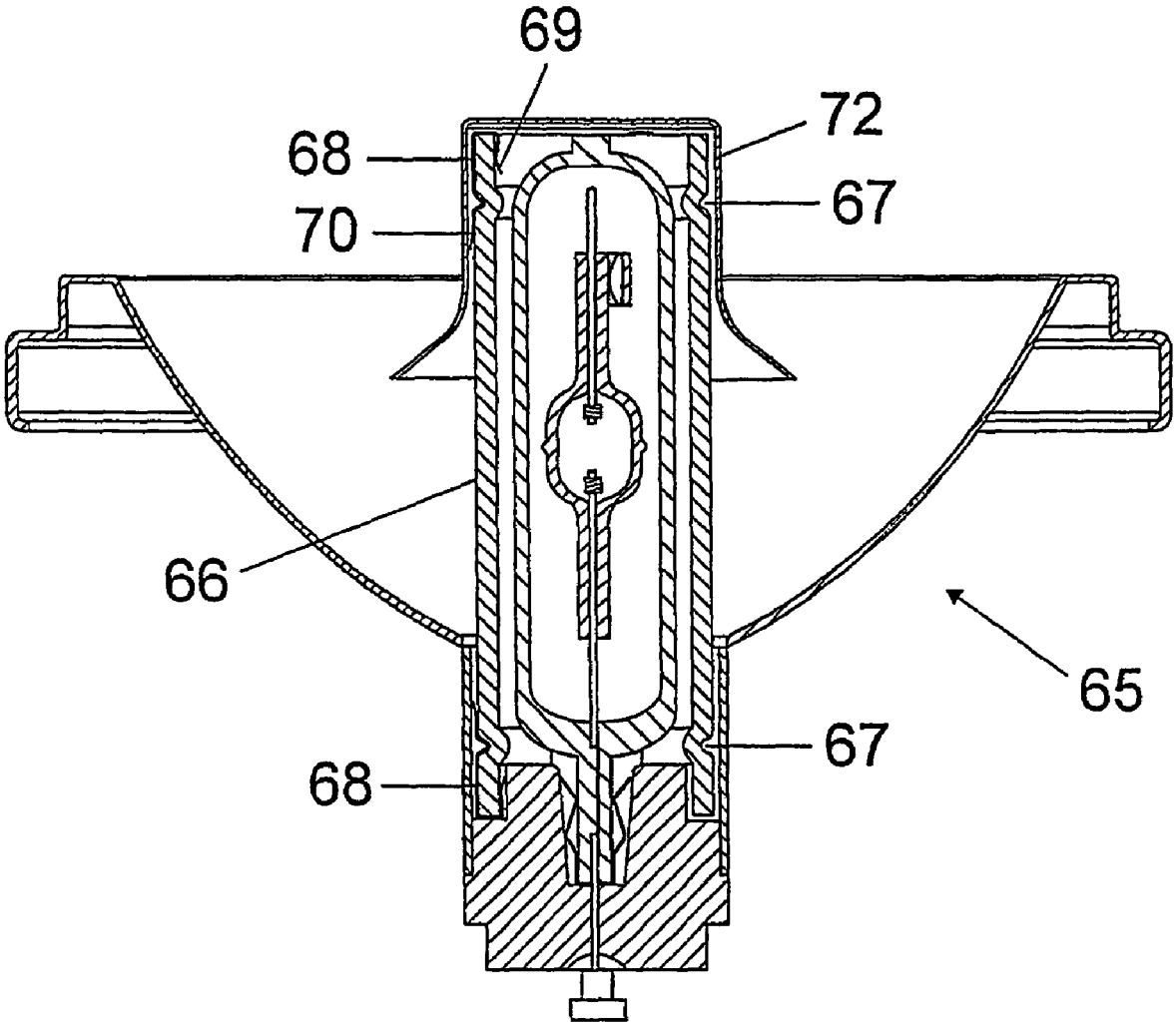
Figure 13:
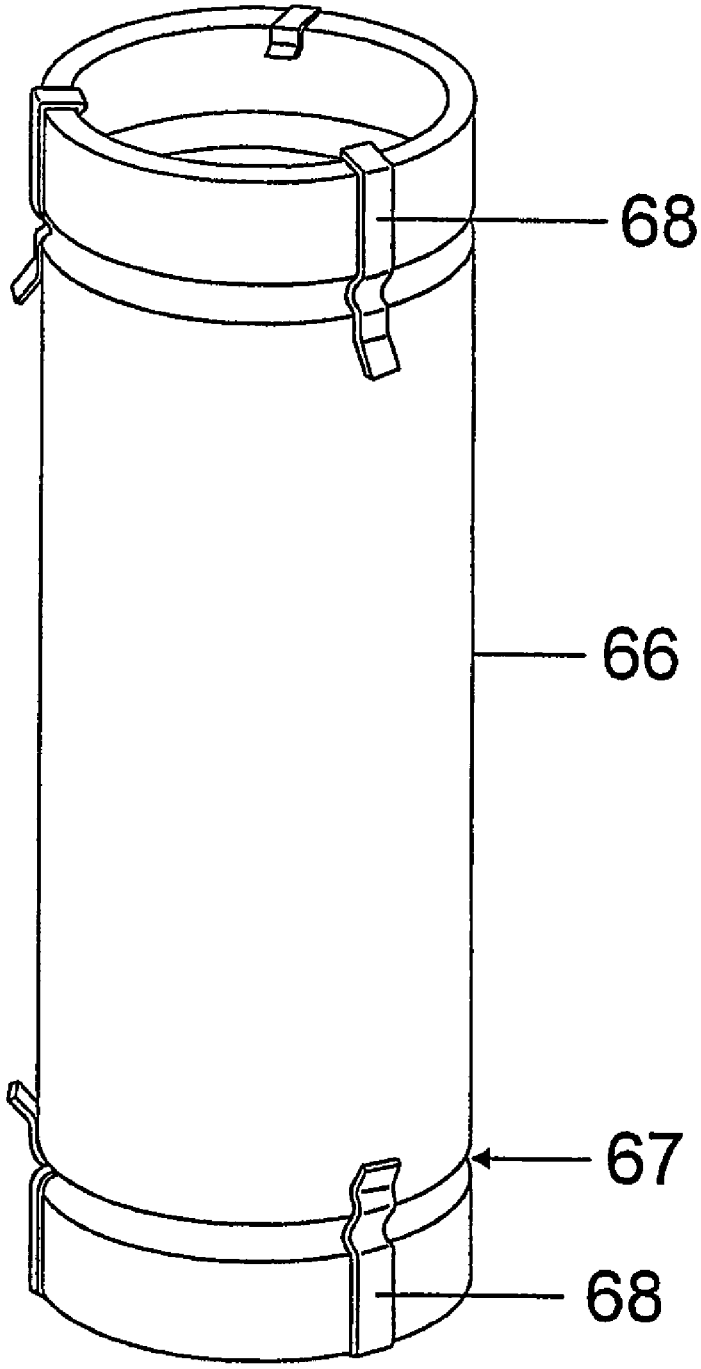

FIG. 12 shows a reflector lamp 65, in which the anti-burst protective tube 66 in each case has a circumferential channel 67 at the upper and lower end. A spring clip 68 is shaped such that it is snapped onto the end of the tube in a similar manner to a so-called tab for files. In this case, a plurality of tabs 68 are distributed over the circumference of the tube, see FIG. 13. The tab is in principle bent in the form of a U with a long outer limb 70 and a short inner limb 69. The outer limb 70 is curved in the form of an S, with the result that, firstly, it is secured in the channel 67 and, secondly, its open end is bent outwards, to be precise to such an extent that it presses in clamping fashion against the inner wall of the cap 72. The inner limb 69 is slightly bent in such a way that it holds the end of the tube 66 in clamping fashion together with the outer limb 70. The circumferential channel can naturally be replaced by local depressions, dents etc. The cover cap naturally does not necessarily require the protruding shield for it to function, but it is advantageous for the desired shielding of the light source.

The light source may be, for example, a halogen incandescent lamp or a high-pressure discharge lamp.

The invention claimed is:

1. A light unit having a concave reflector which is coupled to a base, the reflector having an outlet opening and an axis, the reflector surrounding a light source which is elongated in the axial direction, the light source being surrounded, at a distance, by a cylindrical protective tube elongated in the axial direction and comprising a first open end which is near the base and a second open end which is opposite the first open end, the light unit further comprising an anti-glare device provided at the second open end of the cylindrical protective tube and wherein the anti-glare device is clamped directly onto the cylindrical protective tube via a latching connection arrangement which is integral to the anti-glare device, wherein the anti-glare device comprises a cover cap, wherein the cover cap has a hemispherical termination part arranged so that light emitted from the light source is not directly visible outside the light unit and wherein the diameter of the cylindrical section is 5 to 20% larger than the maximum diameter of the hemispherical termination part.

2. The light unit as claimed in claim 1, wherein the anti-glare device comprises a cylindrical section and a protruding shield is placed on the cylindrical section.

3. The light unit as claimed in claim 1, wherein a step-shaped shoulder exists between the cylindrical section and the termination part.

4. The light unit as claimed in claim 1, wherein the light unit has a base which holds the light source.

5. The light unit as claimed in claim 1, wherein it is in the form of a reflector lamp.

6. The light unit as claimed in claim 1, wherein the anti-glare device is a shaped part, in particular from sheet metal.

7. A light unit having a concave reflector which is coupled to a base, the reflector having an outlet opening and an axis, the reflector surrounding a light source which is elongated in the axial direction, the light source being surrounded, at a distance, by a cylindrical protective tube elongated in the axial direction and comprising a first open end which is near the base and a second open end which is opposite the first open end, the light unit further comprising an anti-glare device fitted over the second open end of the cylindrical protective tube and wherein the anti-glare device has a cylindrical section which is fixed to the protective tube and wherein the anti-glare device further comprises a hemispherical termination part wherein the diameter of the cylindrical section is 5 to 20% larger than the maximum diameter of the hemispherical termination part.

* * * * *